US007458371B2

(12) United States Patent
Ong et al.

(10) Patent No.: US 7,458,371 B2
(45) Date of Patent: Dec. 2, 2008

(54) TOY SOFT DART LAUNCHER

(75) Inventors: Kenlip Ong, Singapore (SG); Kwok Fai Tam, Hong Kong (HK); Tai To Lee, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 31 days.

(21) Appl. No.: 11/540,926

(22) Filed: Sep. 30, 2006

(65) Prior Publication Data

US 2007/0101982 A1 May 10, 2007

Related U.S. Application Data

(60) Provisional application No. 60/722,930, filed on Sep. 30, 2005, provisional application No. 60/733,551, filed on Nov. 4, 2005, provisional application No. 60/846,124, filed on Sep. 20, 2006.

(51) Int. Cl.
*F41B 11/00* (2006.01)

(52) U.S. Cl. ..... 124/65; 124/59

(58) Field of Classification Search ..... 124/59, 124/65

See application file for complete search history.

(56) References Cited

U.S. PATENT DOCUMENTS

| | | | | |
|---|---|---|---|---|
| 1,184,410 | A | | 5/1916 | Bearce et al. |
| 1,282,549 | A | | 10/1918 | Dittrick |
| 1,289,621 | A | | 12/1918 | Blackshear |
| 2,097,749 | A | | 11/1937 | Wade |
| 2,279,386 | A | | 4/1942 | Nelson |
| 2,474,054 | A | | 6/1949 | Jones |
| 2,551,109 | A | | 5/1951 | Fornay |
| 2,674,989 | A | | 4/1954 | Morsch |
| 2,735,221 | A | | 2/1956 | Fields |
| 2,834,332 | A | * | 5/1958 | Guthrie ..... 124/65 |
| 2,962,017 | A | | 11/1960 | Horowitz et al. |
| 2,964,032 | A | | 12/1960 | Noble |
| 3,009,453 | A | | 11/1961 | Ayala |
| 3,065,569 | A | | 11/1962 | Nielsen et al. |
| 3,148,478 | A | | 9/1964 | Miller |
| 3,339,536 | A | | 9/1967 | Glass et al. |
| 3,392,484 | A | | 7/1968 | Ryan et al. |
| 3,774,586 | A | | 11/1973 | Saito |
| 3,869,825 | A | | 3/1975 | Heberlein |
| 4,213,269 | A | | 7/1980 | Grogg, Sr. |

(Continued)

FOREIGN PATENT DOCUMENTS

EP 0700703 A2 3/1996

OTHER PUBLICATIONS

Tippman 98 Custom™ Parts Lists, Tippman Sports LLC, Buffalo Grove, IL, 1 sheet; Jun. 13, 2005.

(Continued)

*Primary Examiner*—Troy Chambers
*Assistant Examiner*—Gabriel J Klein
(74) *Attorney, Agent, or Firm*—Panitch Schwarze Belisario & Nadel LLP

(57) ABSTRACT

A toy launcher for launching soft darts includes a housing; a motor in the housing; a dart magazine subassembly supported by the housing; a dart magazine rotation subassembly supported by the housing and operated by the motor; and a dart launcher assembly supported by the housing and operated by the motor.

4 Claims, 14 Drawing Sheets

U.S. PATENT DOCUMENTS 4,834,058 A 5/1989 Gegere
4,848,307 A 7/1989 Tsao
5,069,649 A 12/1991 Wu
5,256,100 A 10/1993 Wang
5,267,549 A 12/1993 Webber
5,343,849 A 9/1994 Steer
5,373,832 A 12/1994 D'Andrade
5,415,151 A 5/1995 Fusi et al.
5,474,486 A 12/1995 Chilton et al.
5,529,050 A 6/1996 D'Andrade
5,535,729 A 7/1996 Griffin et al.
5,564,964 A 10/1996 Chin-Chien
5,592,931 A 1/1997 Johnson et al.
5,596,978 A 1/1997 Johnson et al.
5,699,781 A 12/1997 Johnson et al.
5,709,199 A 1/1998 Johnson et al.
5,724,955 A 3/1998 Johnson et al.
5,787,869 A 8/1998 Johnson et al.
5,791,326 A 8/1998 Brown et al.
5,791,967 A 8/1998 Yeh
5,797,385 A 8/1998 Thai
5,842,907 A * 12/1998 Niimura et al. ..... 446/435
5,878,735 A 3/1999 Johnson
5,901,693 A 5/1999 Smith
5,924,413 A 7/1999 Johnson et al.
5,924,910 A 7/1999 Liu
5,975,068 A 11/1999 Halter et al.
5,988,152 A * 11/1999 Halter et al. ..... 124/65
6,067,975 A 5/2000 Ginn
6,076,513 A 6/2000 Doherty et al.
6,119,671 A 9/2000 Smith et al.
6,220,237 B1 4/2001 Johnson et al.
6,264,528 B1 7/2001 Doan et al.
6,276,353 B1 8/2001 Briggs et al.
6,280,286 B1 8/2001 Andrews
6,364,162 B1 4/2002 Johnson et al.
6,408,837 B1 6/2002 Johnson et al.
6,428,384 B1 8/2002 Su
6,439,216 B1 8/2002 Johnson et al.
6,527,619 B1 3/2003 Agostini et al.
6,663,463 B1 12/2003 Dougherty et al.
6,807,959 B1 * 10/2004 Murdock et al. ..... 124/61
6,832,604 B1 * 12/2004 Thompson ..... 124/75
6,857,422 B2 2/2005 Pedicini et al.
6,857,930 B1 2/2005 Lawley, Jr.
7,018,264 B2 3/2006 Foster et al.
7,121,917 B2 10/2006 Hardouin et al.
2002/0074343 A1 6/2002 Johnson et al.
2005/0074277 A1 4/2005 Brown et al.
2005/0183708 A1 8/2005 Eddins et al.
2006/0003666 A1 1/2006 Hardouin et al.

OTHER PUBLICATIONS

Air Zone "Rapid Fire Shooter", Just Toys, Inc.; New York, NY; Four (4) sheets (photos of box and disassembled gun); 1995 (see photo of back of box).

* cited by examiner

TOY SOFT DART LAUNCHER

REFERENCE TO RELATED APPLICATIONS

This application is related and claims benefit to provisional U.S. Application Nos. 60/722,930 filed Sep. 30, 2005; 60/733,551 filed Nov. 4, 2005 and 60/846,124 filed Sep. 20, 2006.

BACKGROUND OF THE INVENTION

This invention is a toy for launching soft darts utilizing air pressure.

SUMMARY OF THE INVENTION

One aspect of the invention is a toy launcher for launching soft darts comprising: a housing; a motor in the housing; a dart magazine subassembly supported by the housing; a dart magazine rotation subassembly supported by the housing and operated by the motor; and a dart launcher assembly supported by the housing and operated by the motor.

Another aspect of the toy launcher invention is an elevation subassembly supported by the housing and operated by the motor to raise and lower the launcher with the same motor used to launch the soft darts.

Another aspect of the invention is a method of operating a toy launcher to launch soft darts, the launcher including a housing; a dart magazine subassembly rotatably supported by the housing; a dart magazine rotation subassembly supported by the housing and a dart launcher assembly supported by the housing, the method comprising the steps of: providing a motor in the housing; operating the dart magazine rotation subassembly with the motor; and simultaneously operating the dart launcher assembly with the motor.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
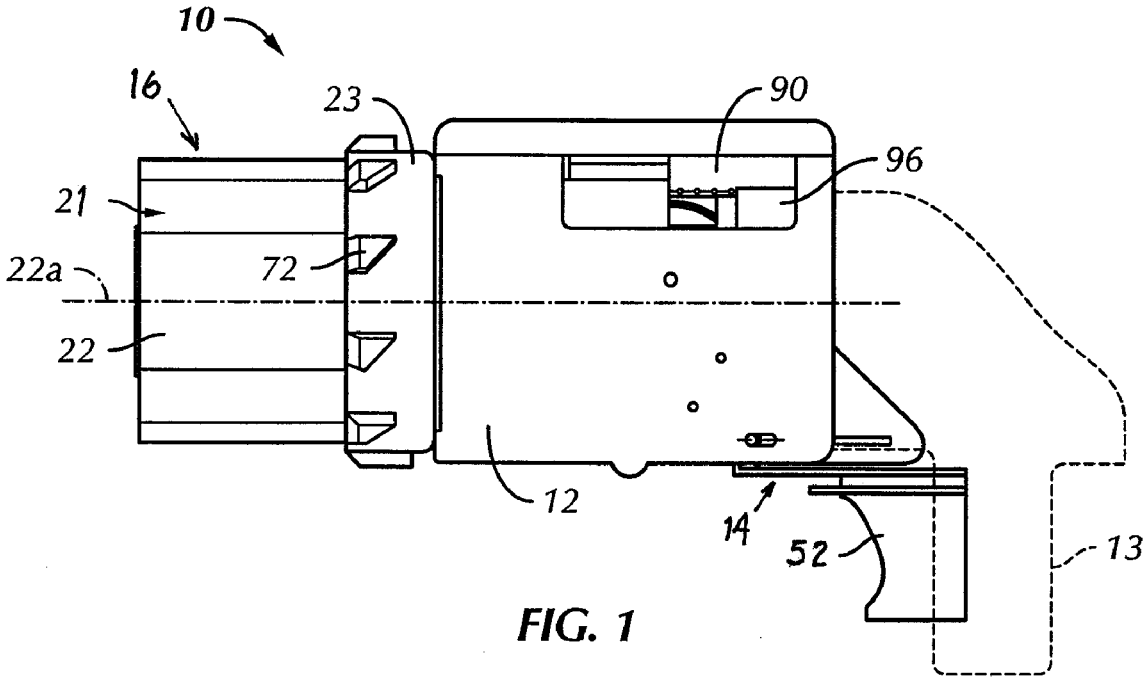
FIG. 1 is an elevation view of the left side of a soft dart launcher in accordance with a first preferred embodiment of the present invention.

Referring to the drawings, wherein like elements are identified by like reference numerals throughout, there is shown in FIGS. 1-8, a toy dart launcher 10 in accordance with a first preferred embodiment of the present invention. The toy dart launcher 10 is employed for sequentially launching a plurality of generally elongated, generally cylindrical soft darts like those darts 108 shown in FIG. 9, either one at a time or continuously as will hereinafter be described in greater detail. The soft darts 108 are of a type well known to those of ordinary skill in the art and preferably are made of a soft material. Each dart is elongated, with a generally cylindrical shaft 108*a* made of a soft closed cell foam or the like, with a first, generally tapered leading end usually weighted by a tip 108*b* of a soft yet more dense material such as a solid elastomeric silicone. The second or back end of the shaft is provided with a generally cylindrical bore extending axially there through for a predetermined distance which is less than the overall length of the dart 108. The dart may or may not have one or more stabilizing fins (not shown). The dart 108 may have a blunt tip 108*b* as shown or a conventional concave, suction tip (not depicted).

Figure 2:
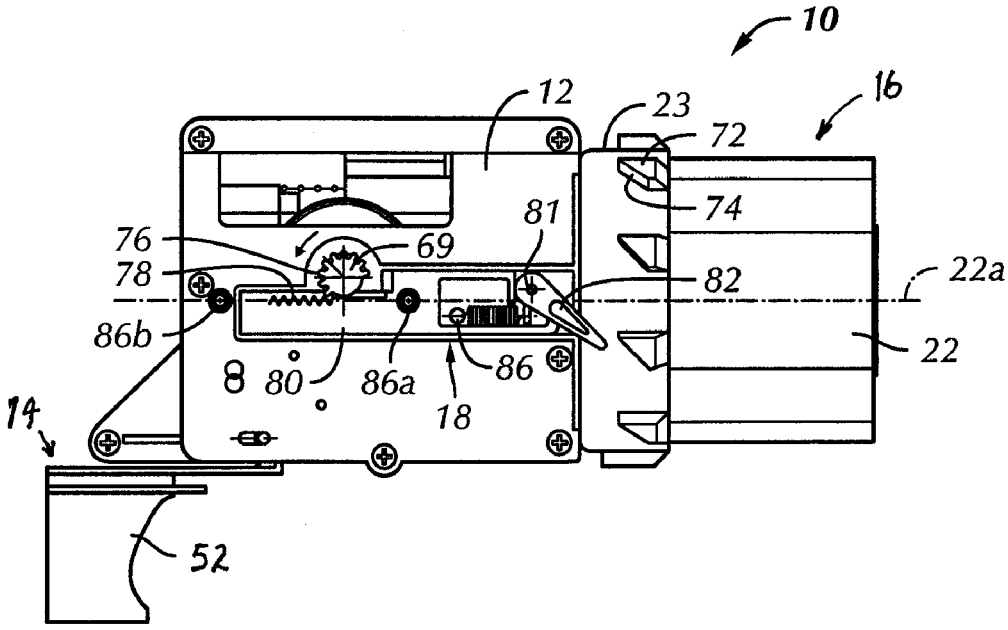
FIG. 2 is an elevation view of the right side of the launcher of FIG. 1.

The toy dart launcher 10 includes a housing 12 and four principal subassemblies, which are seen among the various FIGS. 1-8. A pistol grip handle is indicated in phantom at 13. Three of the subassemblies are best seen in FIG. 2: a trigger subassembly indicated generally at 14, a dart magazine subassembly indicated generally at 16, and a dart launcher subassembly indicated generally at 20. Each of the subassembly 14, 16, 18 and 20 is supported directly or indirectly by one housing 12 which is the equivalent to a chassis or frame of launcher 10. A magazine rotator subassembly indicated generally at 18 is shown in various FIGS. 2-3 and 5-6. The four principal subassemblies 14, 16, 18 and 20 are interconnected in a manner which will hereinafter be described for the purpose of launching the soft darts either one at a time or continuously under the control of an operator.

Figure 4:
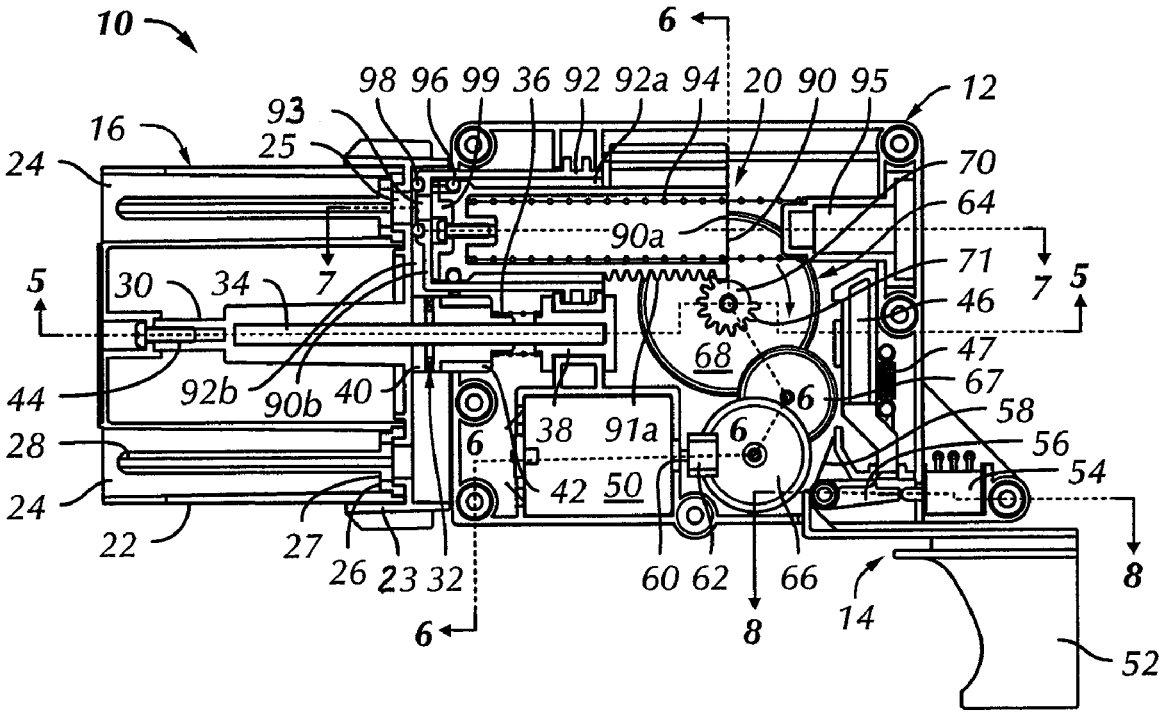
FIG. 4 is a sectioned elevation view of the launcher taken along line 4-4 of FIG. 3.
Figure 5:
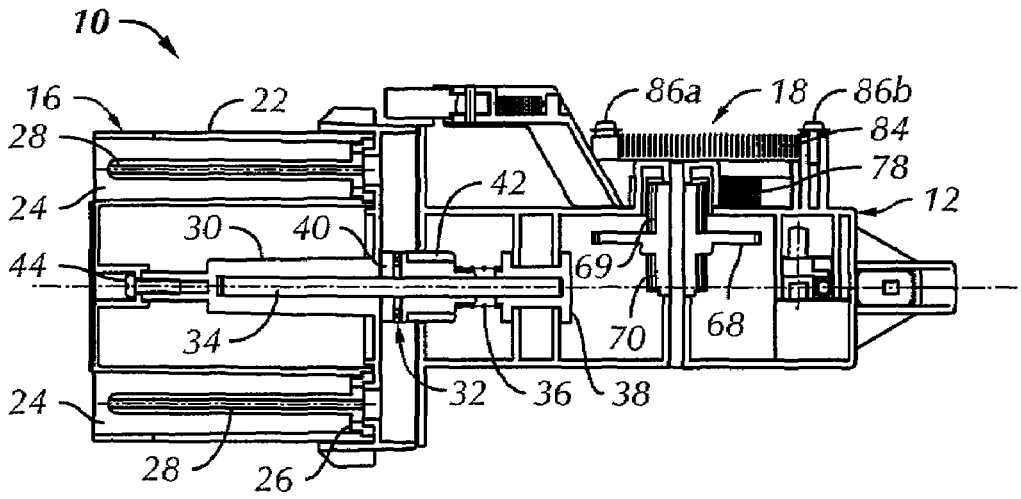
FIG. 5 is a sectioned bottom plan view of the launcher taken along line 5-5 of FIG. 4.

The dart magazine subassembly 16 is comprised of a generally magazine 21 including an elongated cylinder 22 with a back plate 23. The magazine 21 and cylinder 22 having a plurality of generally circumferentially spaced, axially extending bores 24, which constitute launch tubes. In the present embodiment there are ten bores 24 but a greater or lesser number of bores 24 could be provided. The bores 24 are arranged in a circle uniformly spaced from the central axis of rotation 22*a* of the cylinder 22, but are not so limited to that arrangement. The cylindrical bores 24 are sized for receiving the soft darts 108 therein. The rearward end of each of the bores 24 includes a preferably soft or cushioned abutment surface or seat 26, which is adapted to essentially form a contact seal with the rearward end of a dart 108 installed within the cylindrical bore 24. An elongated aiming rod 28 extends along the axial center line of each of the cylindrical bores 24. The elongated aiming rod 28 extends into the elongated axial bore within a dart 108 that has been slid into a dart receiving bore 24 for the purpose of supporting the dart and assisting in the aiming of the dart when launched. The dart magazine cylinder 22 includes a central hub 30 which permits the dart magazine cylinder 22 to be rotatably secured to the housing 12 using a clutch mechanism indicated generally at 32. As will hereinafter be described in greater detail, the clutch mechanism 32 permits the dart magazine cylinder 22 to be rotated in either direction around its central axis 22*a* with respect to the housing 12 and realign one of the dart receiving bores 24 with the dart launcher subassembly 20 for launching a dart. The clutch mechanism 32 also permits the dart magazine cylinder 22 to be quickly removed from the housing and quickly reinstalled after soft darts have been reinstalled within the dart receiving bores 24. In this manner, additional dart magazine cylinders 22 which have been previously loaded with darts may be quickly installed on the toy dart launcher housing 12 for rapid firing of the toy darts. As best seen in FIGS. 4 and 5, the clutch mechanism 32 includes an outwardly extending shaft 34 for engaging the hub 30 of the dart magazine cylinder 22, a pressure spring 36, a spring retainer 38, a clutch 40 and clutch plate 42. The shaft 34 may be splined and the hub 30 similarly bored to be jam fit on the shaft 34. Alternatively, a back plate 23 may be fixed on the shaft 34 and the cylinder with bores 24, a set of rods 28 and a set of darts 108 releasably secured to the back plate 23 by a removable fastener 44 of the like.

Figure 3:
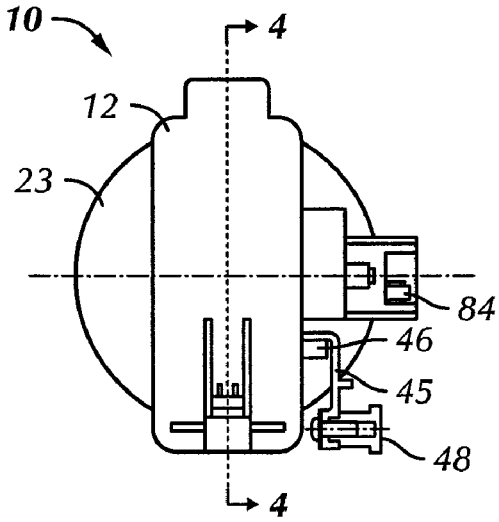
FIG. 3 is an elevation view of part of the rear side of the launcher of FIG. 1.
Figure 8:
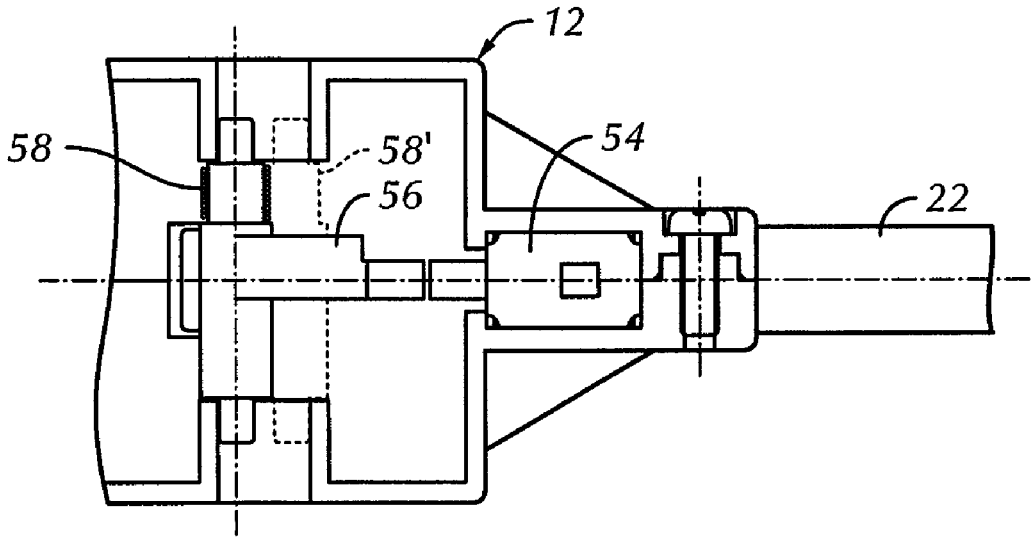
FIG. 8 is a sectioned top plan view of the trigger mechanism taken along line 8-8 of FIG. 8.

The toy dart launcher 10 is operated by a battery powered electric motor 50. One way of controlling the operation of the electric motor 50 is by the trigger subassembly 14. The trigger subassembly 14 as shown in FIGS. 1, 3 and 5 includes a spring loaded trigger 52, a switch 54, a switch lever 56 and a torsional spring 58. When the trigger 52 is squeezed, the switch lever 56 is pushed rearwardly into engagement with the actuator of switch 54 as shown in FIG. 4. As shown in FIG. 8, the forward end of switch lever 56 is slidably and pivotally mounted and biased by torsional spring 58 to the horizontal orientation shown in FIG. 4 and away from the switch 54. Engagement or squeezing of the trigger 52 by an operator forces the switch lever 56 into contact with the switch 54. A selector lever 46 is slidably positioned above the end of switch lever 56 in contact with switch 54 and, as is further shown in FIG. 4, is normally biased away from the lever 56 by spring 47. When the piston 91 is drawn back by the pinion 70, at the extreme end of its travel it will strike the upper angled surface of lever 46 and cam the lever 46 down until the lowermost end of the lever 46 strikes the switch lever 56 and rotates it downward, out of contact with the actuator of switch 54. Thus, in the configuration of FIG. 4, one dart will be fired before the switch lever 56 is disconnected from switch 54 and the motor 50 will not be reactivated until the trigger 52 is released and resqueezed. For continuous fire, a manually operated selector 48 with selector retainer 45 (see FIG. 3) is provided on the outside of the housing 12. Selector 48 is coupled with selector lever 46 through the housing 12 and when rotated from its position in FIG. 3 has a lip caught by the retainer 45 and held in rotated position. In that rotated position, the end of selector lever 46 is forced below the withdrawn switch lever 56. The selector 48 and retainer 45 hold the selector lever 46 down so that it is not struck by the reciprocating piston 91 and where it cannot move the switch lever 56 until selector 48 is returned.

Figure 6:
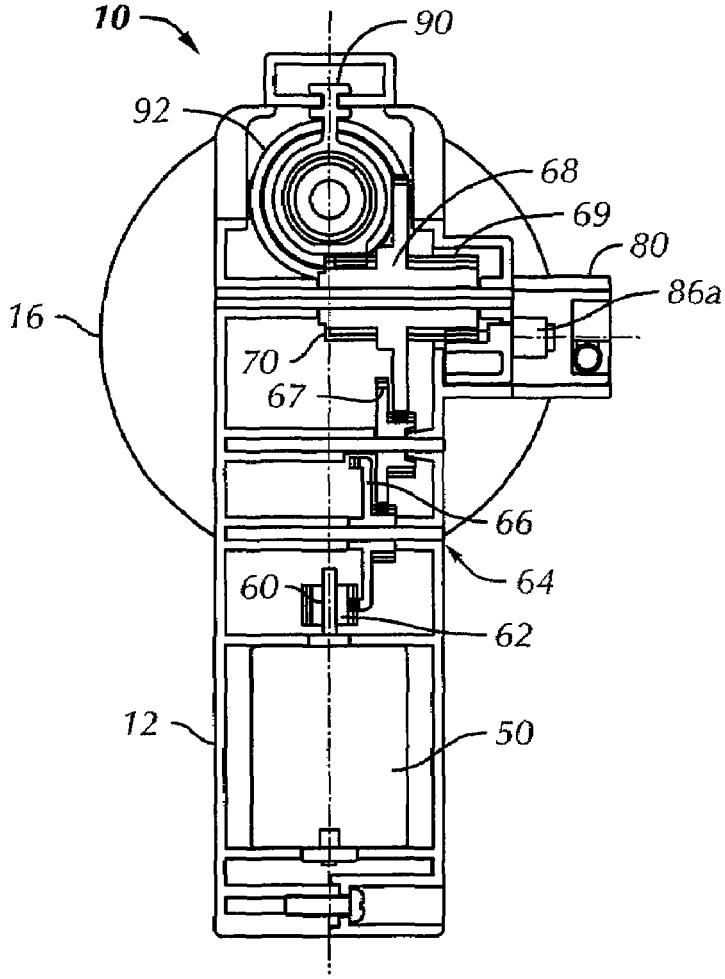
FIG. 6 is a sectioned rear elevational view of the launcher taken along lines 6-6 of FIG. 4.

As shown in FIGS. 4 and 6, the electric motor 50 includes an output shaft 60 which rotates whenever power is supplied to the electric motor 50. A pinion 62 is secured to the motor output shaft 60 for rotation therewith. The pinion 62 in turn meshes with the crown gear portion of a first combination crown/spur reduction gear 66 in a drive train indicated generally at 64. The drive train 64 is a multigear reduction train that includes, in addition to crown/spur gear 66, a second spur/spur reduction gear 66 and a third spur/spur reduction gear or "main" driven gear 68 that supports two output pinions, a first output pinion 69 (FIG. 8), which is utilized with the dart magazine rotator subassembly 18, and a second output pinion 70, which is utilized with the dart launcher subassembly 20. Both pinions 69, 70 are sector gears as can be seen in FIGS. 2 and 4. That is, they include teeth only around part of their circumference.

Details of the dart magazine rotator subassembly 18 are shown in FIGS. 1, 2, and 4. As shown, the proximal end of the dart magazine cylinder 22 includes a plurality of circumferentially spaced apart generally radially outwardly extending lug members 72. Each of the lug members 72 includes a generally angled surface 74 which, in the present embodiment, extends at an angle of approximately forty-five degrees with respect to the remainder of the lug members 72. As best shown in FIG. 2, the pinion 69 associated with the dart magazine rotator subassembly 18 is a sector gear that includes a plurality of radially outwardly extending gear teeth 76 extending around only a proximately two-thirds of the circumferential outer surface. The remainder of the outer surface of the pinion 69 does not contain any gear teeth. The gear teeth 76 of the pinion 69 engage the teeth of a corresponding rack 78 located along one side of an elongated member 80 of the dart magazine rotator subassembly 18. The distal end of the elongated member 80 includes the magazine turner in the form of an angled lug 82 extending outwardly therefrom on a pivot 81. A coil spring 84 (seen only in FIG. 5 and removed from FIG. 2 for a clarity) is also secured to the elongated member 80 on post 86 and to housing 12 at post 86b to bias the elongated member 80 toward a first direction, rearwardly (leftwardly when viewing FIG. 8). In this manner, when the pinion 69 is driven to rotate in a counterclockwise direction when viewing FIG. 8, the geared teeth 76 of the pinion 69 engage the teeth of the rack 78 thereby causing the elongated member 80 to move forwardly (rightwardly when viewing FIG. 8) against the bias of the spring 84. The rightward movement of the elongated member 80 causes the angled lug 82 to engage the angled surface 74 on one of the lug members 72, thereby causing the dart magazine cylinder 22 to rotate a predetermined distance so that a different dart receiving bore 24 is aligned with the dart launcher subassembly 20 for launching a dart. Once the pinion 69 has rotated to the point that the last gear tooth 76 is disengaged from the rack 78, the bias of the spring 84 causes the elongated member 80 to translate leftwardly to its original position as shown in FIG. 5 until such time as the pinion 69 rotates to the point where the gear teeth 76 again engage the teeth of the rack 78 for rightward movement of the elongated member 80. When a user engages and holds the trigger 52, electrical power from the power supply 106 is continuously supplied to the electric motor 50, the motor 50 causes the pinion 69 to continuously rotate. The continuous rotation of the pinion 68 causes the elongated member 80 to reciprocate rightwardly and leftwardly on a cyclic basis to thereby rotate the dart magazine cylinder 22 on a continuous, periodic or cyclic repeated basis.

Figure 7:
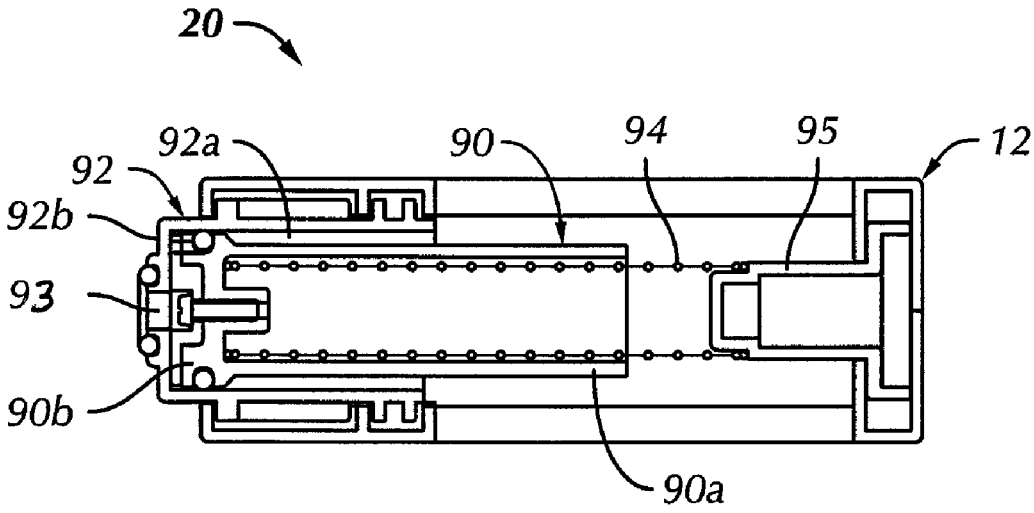
FIG. 7 is a sectioned top plan view of the air pump taken along line 7-7 of FIG. 4.

Referring now to FIGS. 4 and 7, the dart launcher subassembly 20 is comprised of an air piston 90 reciprocating within a cylinder 92. A coil spring 94 has a first end which engages the back or rear surface of the inside of the head end 90*b* of air piston 90 and a second end which is held in place by a spring retainer 96. In this manner, the spring 94 biases the air piston 90 toward the left when viewing FIG. 4. A seal, such as an 0-ring seal 96, is located between the air piston 90 and the cylinder 92 preferably on the piston. A rack 91 on the tubular body 90*a* of the air piston 90 can be engaged by the gear teeth 71 of pinion 70. As can best be seen from FIG. 4 the gear teeth 71 on pinion 70 extend approximately two-thirds of the way around the circumference of the pinion 70 with no teeth on the remaining portion of the pinion 70. As can be appreciated from FIG. 4, when the pinion 70 is rotated in a clockwise direction, the gear teeth 71 of the pinion 70 engage the teeth 91*a* of the rack 91 thereby causing the air piston 90 to move rightwardly against the bias of the spring 94. The rightward movement of the air piston 90 causes air to enter the cylinder 92 on the head end 90*b* of the air piston 90. The cylinder 92 or the piston 90 may be provided with a suitable one way valve (not depicted), if desired, to permit air to be more easily drawn into the cylinder 92 during this retraction of the piston 90. Once the rotation of the pinion 70 reaches the point where the gear teeth 71 no longer engage the rack 91, the air piston 90 is released and rapidly moves toward the left, when viewing FIG. 4, under the bias of the spring 94. The rapid leftward movement of the air piston 90 pressurizes the air present within the cylinder 92 on the head side 90*a* of the air piston 90, causing the air to be rapidly propelled out of the cylinder 92 through an opening or passageway 93 (FIG. 4) in the forward or head end 92*b* of the cylinder 92 and openings 25 through back plate 23 of the dart magazine cylinder 22 and openings 27 through seats 26 around the base of the aiming rod 28 in the bore 24 aligned with the opening 93. The propelled air engages a rearward end of the soft dart (not shown) within the dart receiving bore 24, which is aligned with the passageway 93 of the cylinder 92, thereby launching the soft dart out of the bore 24. Preferably, a second seal 98, such as a second O-ring seal, is positioned between the passageway 93 and the bore 24, preferably on the face of the cylinder 92 at the head end, where it rides against the exposed rear surface of the back plate 23, so that all of the pressurized air from cylinder 92 engages and propels the soft dart out of the aligned, dart receiving bore 24. The is no valving in the dart launcher subassembly that permits pressurized air to be maintained in the subassembly for delayed release.

From the foregoing it can be seen that the present invention comprises a toy dart launcher capable of launching a single soft dart or a plurality of soft darts on a generally continuous sequential basis without the use of a pressurized air cylinder. It will be appreciated by those skilled in the art that changes could be made to the embodiment described above without departing from the broad inventive concepts thereof.

Figure 9:
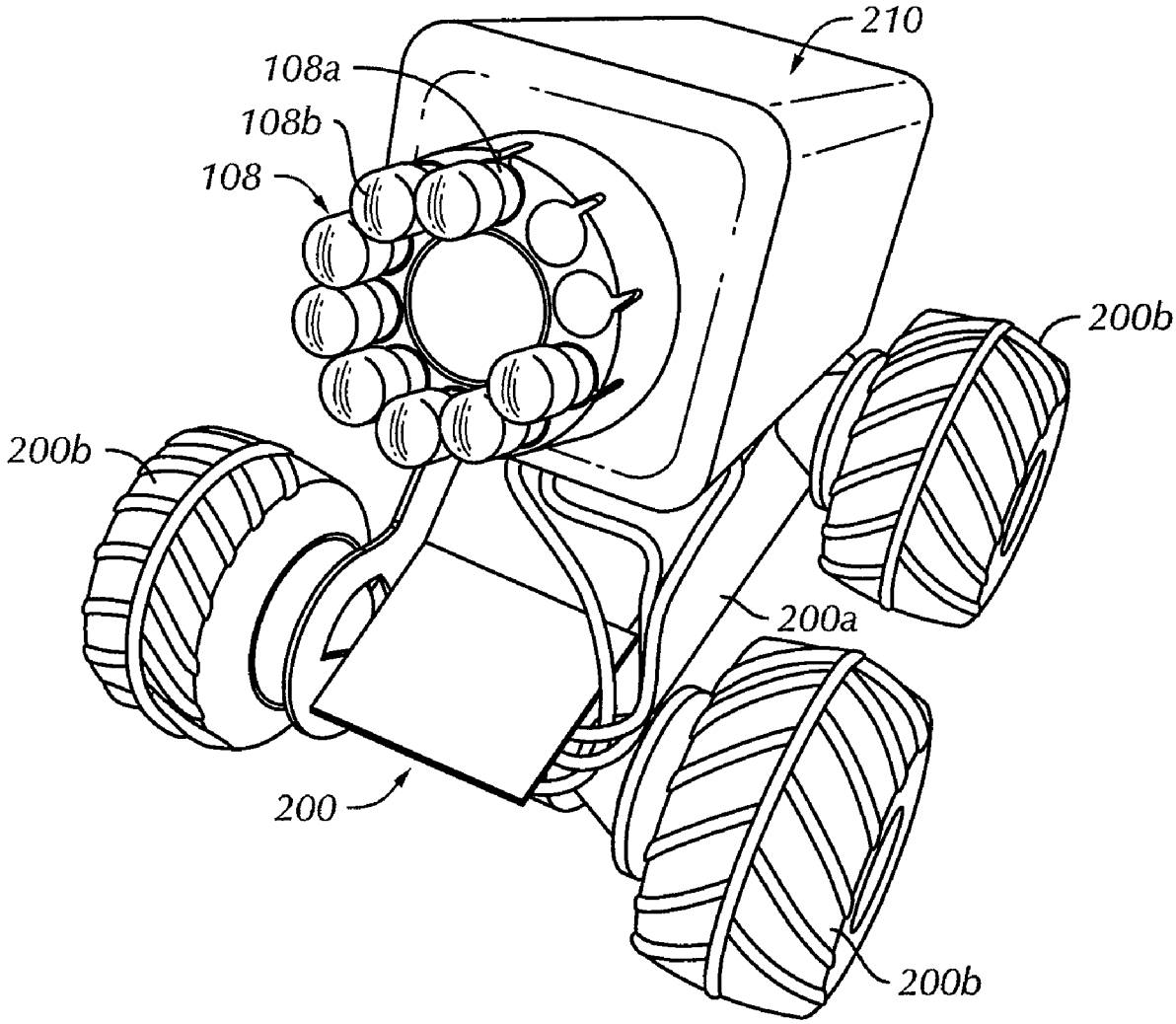
FIG. 9 shows a second embodiment toy dart launcher of the previous FIGS. 1-8 mounted on a remotely controlled toy vehicle and slightly modified for remote control.
Figure 10:
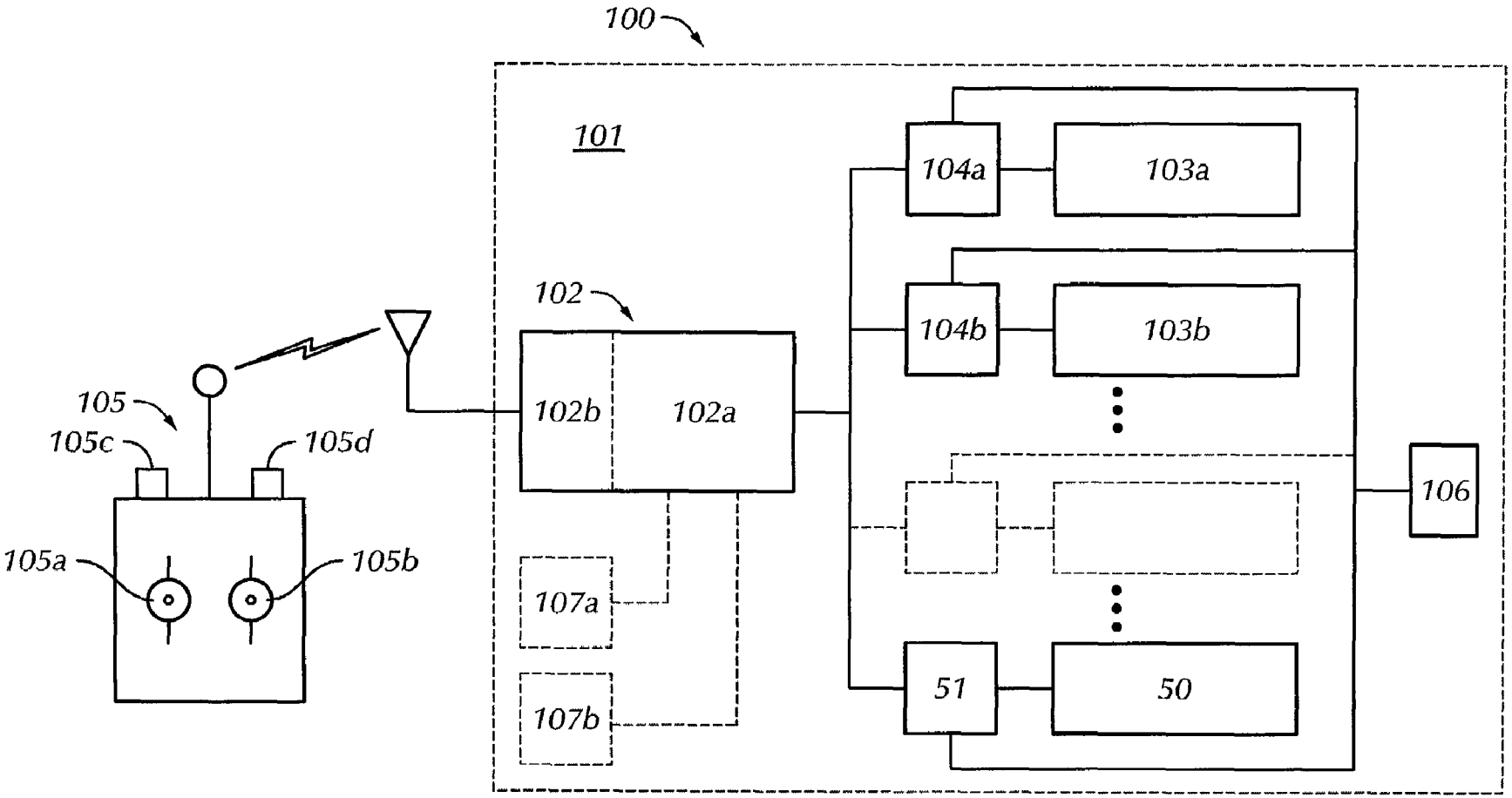
FIG. 10 is a block diagram of circuitry used in a controlled toy vehicle mounting the second embodiment soft dart launcher of FIG. 9.

For example, the toy dart launcher 10 may be incorporated into or may be removably attached to a remotely controlled (RC) toy vehicle with the trigger 52 being remotely operable. Referring now to FIGS. 9-10, alternatively, a second preferred embodiment toy dart launcher 210 may be incorporated integrally into a toy vehicle 200, preferably a remotely controlled toy vehicle, having a chassis 200*a* and maneuver means 200*b*, which may be two or more road contacting wheels, a pair of road contacting tracks, a plurality of walking legs or a combination of the foregoing. FIG. 10 depicts in block diagram form the control circuitry 101 and other electrical components of a conventional remotely controlled toy vehicle 100, of a type on which a slightly modified version 210 of the dart launcher 10 of FIGS. 1-8 might be mounted. The circuitry includes a controller 102 with a processor 102*a* plus any necessary related elements such as memory. If the vehicle 100 is wirelessly remotely controlled, it includes a receiver 102*b* coupled with processor 102*a* and responsive to a remote control transmitter 105. Transmitter 105 has maneuver control members such as toggles 105*a*, 105*b* and buttons 105*c*, 105*d* for reversible control of motor 50. The vehicle 100 has at least one and preferably two or more, preferably reversible maneuver motors 103*a*, 103*b*, etc. One motor may provide just propulsion and the other may pivot one or more wheels to provide steering or each motor 103*a*, 103*b* may control the maneuver means 100*b* on a separate side of the chassis 100*a* for propulsion and steering by independent control of the motors. The maneuver motor(s) 103*a*, etc. are controlled by the processor 102*a* through motor control subcircuits 104*a*, 104*b*, etc, which, under control of processor 102*a*, selectively couple each maneuver motor 103*a*, 103*b*, etc. with an electric power supply 106 such as one or more disposable or rechargeable batteries. The gun motor 50 can be controlled in the same way through a motor control subcircuit 51, which takes the place of switch 54 in the first embodiment launcher 10. The entire trigger subassembly 14 of the first embodiment 10 is replaced simply by the vehicle controller (102) operating a motor 50 when commanded by the user.

The toy dart launcher 210 of the second embodiment is essentially similar to the first embodiment launcher 10 described above. Specifically, the second embodiment launcher 210 includes the dart magazine subassembly 216, the dart magazine rotator subassembly 18 (hidden in an outer housing 212), and the dart launcher subassembly 220.

The second embodiment launcher 210 generally differs from the first embodiment launcher 10 in the manner in which it is actuated. As stated above, rather than a manually actuated trigger 22 and switch 54, the motor 50 of the launcher 210 is actuated by the vehicle controller 102. Once actuated, the motor 50 drives the launcher 210 like it drives the first embodiment launcher 10. While configured for automatic firing, the launcher 10, 210 can be configured mechanically or electro-mechanically to fire one dart at a time, for example by including a switch which may be in the form of a sensor and which indicates when the last or nearly last motion or action associated with a dart firing cycle is completed or by automatically timing of the motor actuation with the vehicle controller 102.

Figure 11:
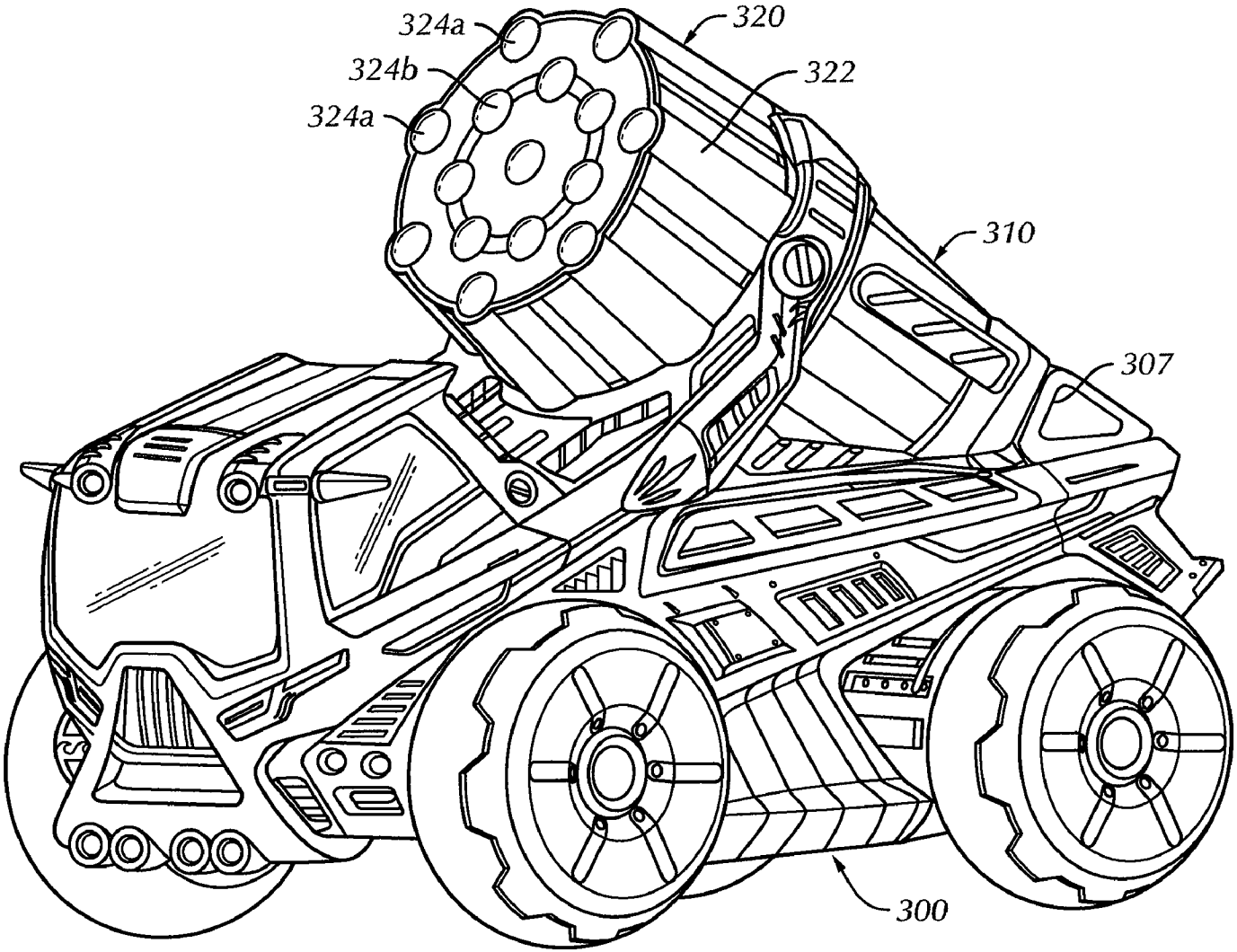
FIG. 11 is a front perspective view of a soft dart launcher in accordance with a third preferred embodiment of the present invention mounted on a remotely controlled toy vehicle.

FIG. 11 depicts a third embodiment toy dart launcher indicated generally at 310 mounted on another motorized toy vehicle 300, like vehicle 200 of FIGS. 9-10 but with different styling. It is noted that the cylinder 322 of the launcher subassembly 320 has two concentric rings of hollow bores 324 instead of a single ring like the embodiments of FIGS. 1-9. The circuitry in toy vehicle 300 is the same as circuitry 101 of FIG. 10 and the vehicle 300 can be operated in the same way.

The toy dart launcher 310 is preferably pivotally mounted to the car 300 by a pair of side brackets 307, but is not so limited and may be mounted to the vehicle 300 in any other manner that secures the launcher 310 to the vehicle 300, in a desired fashion either fixed or pivotable. The third preferred embodiment 310 is configured to alternately fire darts 108 from the seven inner bores 324*b* and seven outer bores 324*a* as the magazine cylinder 322 rotates during operation, as was described above. However, the toy dart launcher 310 is otherwise constructed and operates in a very similar manner to the launcher 10 and 210.

Components of the third launcher 310 which are equivalent to the components of the first embodiment launcher 10 are identified by the same reference numbers incremented by 300. Otherwise, the numbering of launcher 10 is maintained. The exception to this are the components 46-48, 52 and 56-58 of the original trigger subassembly, which are now omitted.

The inclusion of the inner and outer bores 324*b*, 324*a*, which extend axially within the magazine cylinder 322 result in a set of seven (7) inner magazine opening 325*b* and a set of seven (7) outer magazine openings 325*a* (FIGS. 14 and 15) located at a rear surface of the magazine cylinder 322. In addition, a seal in the form of a generally flexible membrane plate 398 is mounted to an outlet or head end of the cylinder 392 and includes an "inner" hole 398*b* and an "outer" hole 398*a*. The inner hole 398*b* and outer hole 398*a* are in communication with the pressurized air in the cylinder 392 through a radially inwardly located passageway 393*b* and a radially outwardly located passageway 393*a* in the wall of the cylinder 392 at the outlet head end. When the magazine cylinder 322 is mounted to the housing 312, the rear face of the magazine cylinder 322 comes into facing engagement with the membrane plate 398 such that a seal is created between the membrane plate 398 and the facing surface on the back plate 323 of the magazine cylinder 322. In addition, as the magazine 322 rotates relative to the housing 312, the outer passageway/hole 393*b*, 398*b* and inner hole 393*a*, 398*a* alternatively become aligned with the outer and inner magazine holes openings 325*a*, 325*b*, respectively, to alternatively urge pressurized air into the outer and inner bores 324*a*, 324*b* for firing the darts. Accordingly, as the magazine cylinder 322 rotates relative to the housing 312, the darts will be alternatively fired from the outer and inner bores 324*a*, 324*b*.

Figure 13:
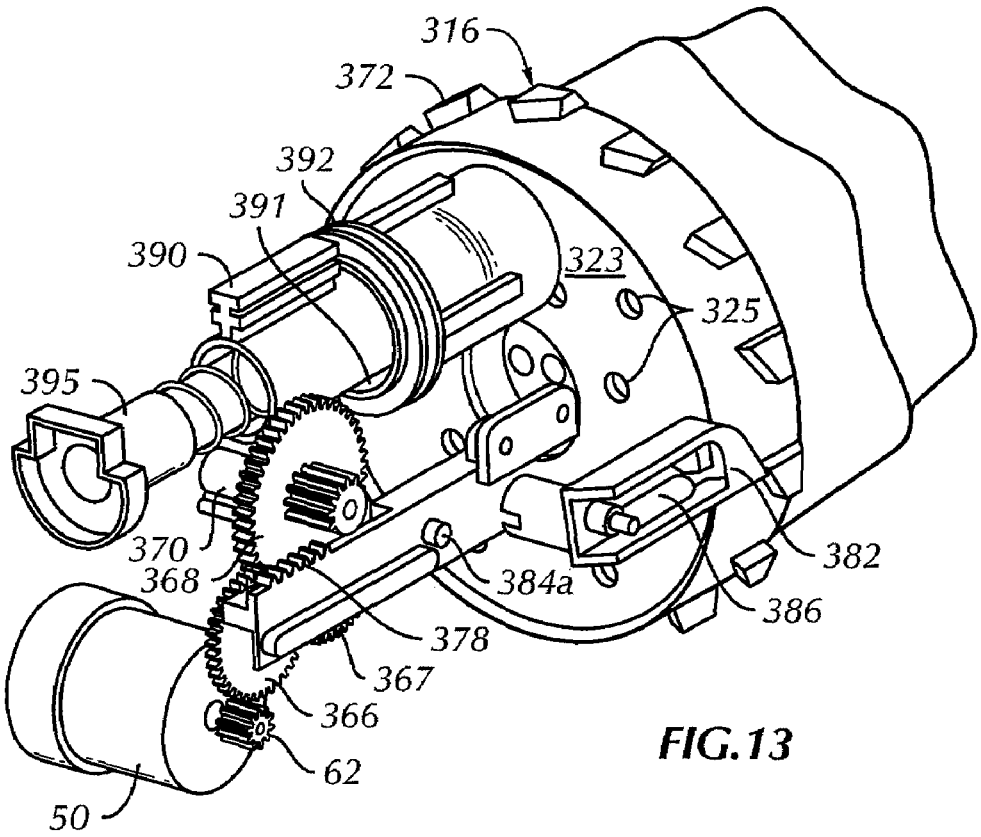
FIG. 13 is a rear perspective view of the soft dart launcher of FIG. 12 with the side supports and housing removed for clarity.
Figure 15:
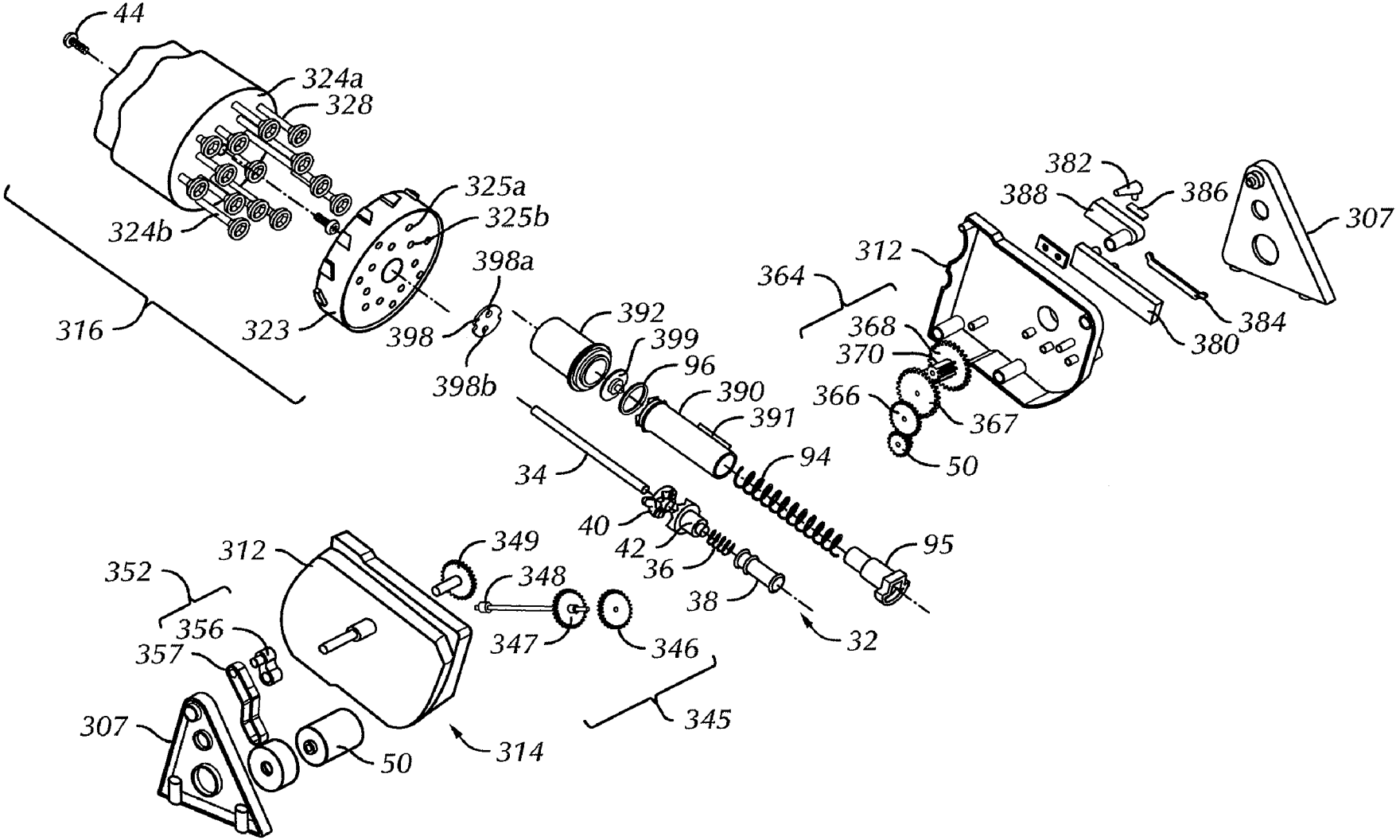
FIG. 15 is an exploded view of the soft dart launcher of FIGS. 12-14.

Referring to FIGS. 13 and 15, the dart magazine rotator subassembly 318 includes an L-shaped bar 388 mounted to the elongated member 380 and a biasing spring 386 that biases the angled pivotally mounted lug 382 to an extended position. In the extended position, a distal tip of the angled lug 382 extends beyond an edge of the L-shaped bar 388. In operation, the distal tip initially engages the angled surface 74 of one of the lug magazine members 72 and the angled lug 382 drives the rotation of the magazine cylinder 322 as the first output pinion 369 drives the linear, sliding motion of the elongated member 380. When the elongated member 380 reaches the end of its stroke and is urges rearwardly toward the rear of the housing 312 under urging of the coil spring 384, the rear face of the angled lug 382 proximate the distal tip contacts a front edge of the next lug member 72 on the magazine cylinder 322 and pivots to a clearance position (not shown). The angled lug 382 pivots on the L-shaped bar 388 to clear the lug member 72 to the clearance position and when the elongated member 380 slides further rearwardly, the bias spring 386 urges angled lug 382 to pivot back to its extended position such that the angled lug 382 engages the angled surface 74 of the next lug member 72 for further indexing of the magazine cylinder 322.

Figure 12:
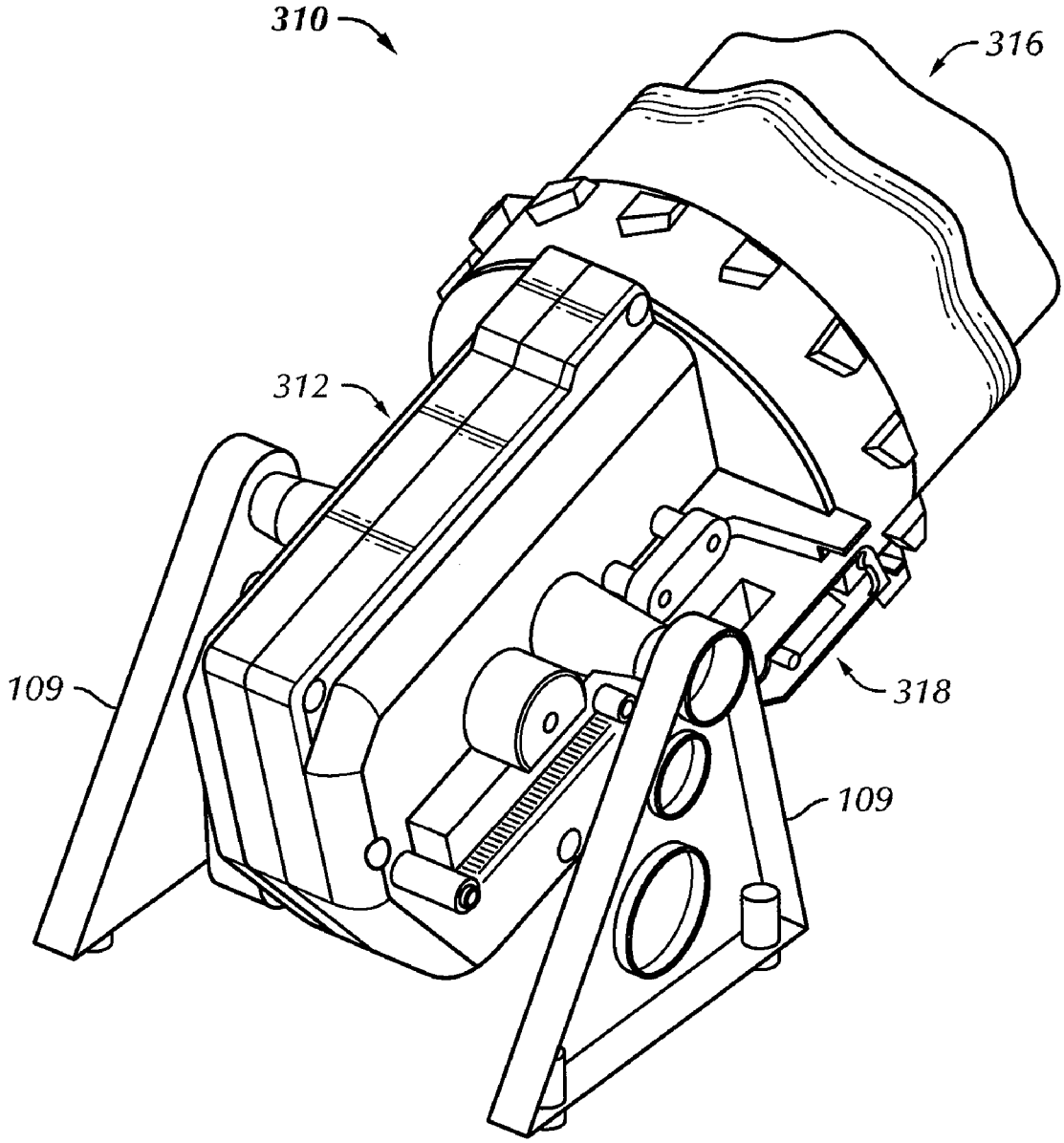
FIG. 12 is a rear perspective view of the third embodiment soft dart launcher of FIG. 11 pivotally mounted on a set of support.
Figure 14:
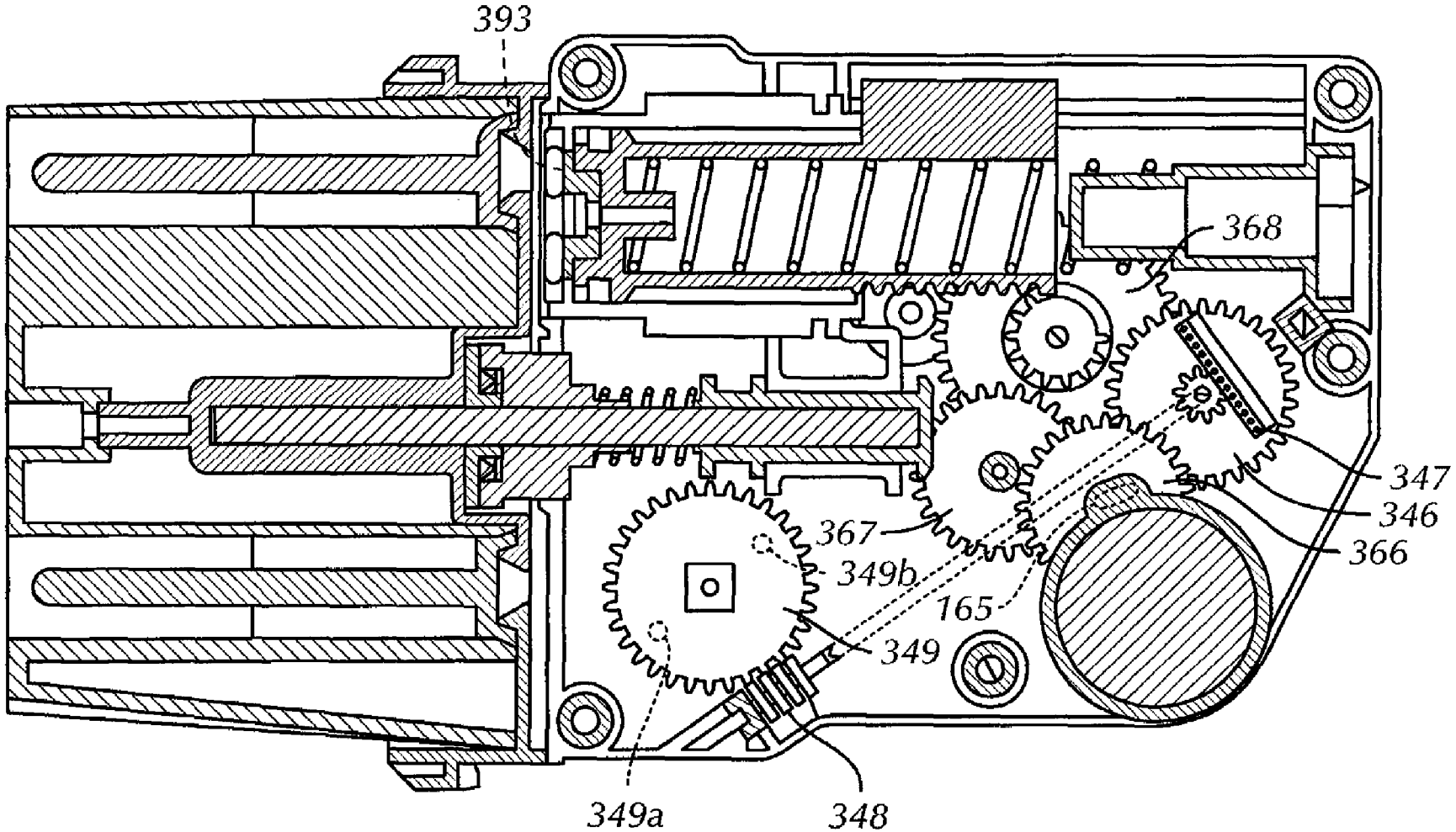
FIG. 14 is a cross-sectional view of the soft dart launcher of FIGS. 12-13.

Referring to FIGS. 14 and 15, an additional difference is that the launcher 310 is pivotably attached to the toy vehicle 300 on brackets 307 to enable the launcher 310 to elevate from a first, horizontal storage position shown in FIG. 14 to a second, angled launch position shown in FIGS. 11 and 12. This can be accomplished by using a separate motor (not shown) or, more preferably, by using the motor 50 which is used to actuate the firing of the darts 108 from launcher 310.

Again, the motor 50 has an output shaft 60 with a pinion 62 (both phantom). Specifically, the pinion 62 engages a "toggle" gear 366, preferably a spur configuration, which, when driven in a first direction, engages with and drives the remaining gears 367 and 368 of multi-geared reduction gear train 364 (like gear train 64 of the first embodiment launcher 10) to launch soft darts from the launcher 310 in a manner similar to that described above with respect to the first embodiment launcher 10. When the motor 50 is driven in a second direction, the toggle gear 366 shifts along a slot 365 to fall out of engagement with the reduction gear train 364 and into engagement with a second spur gear 346 which is part of a gear train indicated generally at 345. Gear train 345 is part of an elevation subassembly indicated generally at 314. Preferably, the elevation mechanism train 345 includes a crown gear 347, which engages with and is driven by the second spur gear 346. A shaft carries rotation of crown gear 437 to a worm 348 driving a worm gear 349. Worn gear 349 drives an elevation mechanism 352 comprising an eccentric in the form of a crank 356 rotatably coupled with a first end of a link 357, an opposing end of which is pivotally coupled to the toy vehicle 300 on which launcher 310 is mounted. The rear end of launcher 310 is also pivotally mounted to vehicle 300. Operation of the elevation gear train 345 causes the crank 356 to be rotated. Contact switches (107*a*, 107*b* in phantom in FIG. 10) are positioned so that each is contacted when the launcher 310 is elevated to its highest position and depressed to is lowest position respectively, to signal controller 102 to cut power to motor 50. Switches 107*a*, 107*b* may be of any type from a pair of slide contacts to pressure or other types of contact switches to light detectors. Alternatively, a single light detector might be used with a gear 349 to signal positions of gear 180° apart (i.e. two holes 349*a*, 349*b* through gear 349 spaced 180° apart) to permit a light beam to pass through the gear.

Although this elevation subassembly 314 is preferred, particularly where the launcher is to be secured at two places to a vehicle or other support, the elevation mechanism be configured differently.

Figure 16:
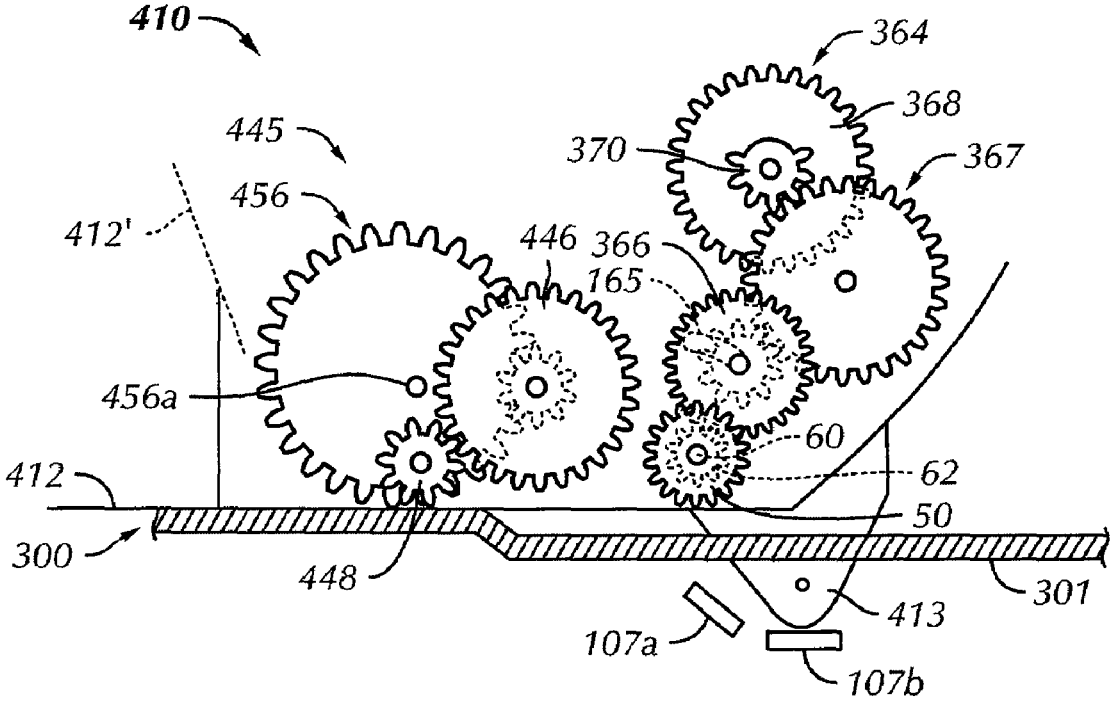
FIG. 16 is an enlarged schematic of a toggle gear and elevation mechanism of a fourth embodiment soft dart launcher.

Referring to FIG. 16, a fourth variation of the invention in the form of another elevation subassembly 414 is depicted. Undepicted portions of the launcher 410 are same as those of launcher 310. The pinion 62 of motor 50 can engage with toggle gear 366, which, when driven in a first direction, engages with and drives the multi-geared reduction gear train 364 to launch soft darts from the launcher 110 in a manner similar to that described above with respect to the first and third embodiment launchers 310. When the motor is driven in a second direction, the toggle gear 366 shifts along slot 165 to fall out of engagement with the reduction gear train 364 and into engagement with a second spur gear 446 of a second elevation train 445. Gear 446 is engaged with a third spur gear, a pinion 448 engaged a third spur gear in the form of an elevation mechanism 169. Preferably, the elevation mechanism 152. Pinion 149 is drivingly engaged and, preferably, rotatably fixed with an elevation mechanism 452, preferably in the form a large cam 456 eccentrically coupled with pinion 448. Cam 456 interacts with a surface 301*a* of toy vehicle 300, or other vehicle or surface. The cam 456 is configured such that rotation of the cam 456 causes the launcher 110 to move between the horizontal storage position indicated in solid by lower housing wall portion 412 and the angled launch position indicated by phantom wall portion 412. In this way, rotating the cam 456 one hundred eighty degrees lifts the launcher 410 from the storage position to the launch position, and rotating the cam 456b another one hundred eighty degrees lowers the launcher 110 from the launch position back to the storage position. The back end of launcher 410 is pivotally coupled to vehicle 300 by one or more flanges 413 from housing 412. Preferably, there are limit like switches 107*a*, 107*b*, which signal control circuitry 102 to cut power to the motor 50 when either the storage position or the launch position is reached so that the launcher 110 does not overshoot the desired position. Other limit switch arrangements and locations can be used, including a single optical sensor which shines light 10, 210, 310, 410 through hole 456*a* and over cam 456 at angular orientations of cam 456 180° apart.

Furthermore, although the toggle gear 366 is preferred, it is within the present invention that the motor 50 individually drive a dart firing/advancing subassembly and an elevation subassembly in different other ways. For instance, the pinion of the motor 450 can drive a pair of gears, either directly or indirectly, each of which is a part of a separate drive train of a separate subassembly through oppositely oriented, generally conventional slip clutches (not shown), such that rotation of the pinion 60 first direction causes rotation of the first gear train and no rotation of the second gear train, and rotation of pinion 60 in a second direction causes rotation of the second gear train and no rotation of the first gear train. In this way, the motor 50 can operate to rotate pinion 60 in the first direction to launch soft darts from the launcher and in the second direction to raise and lower the launcher.

Figure 17:
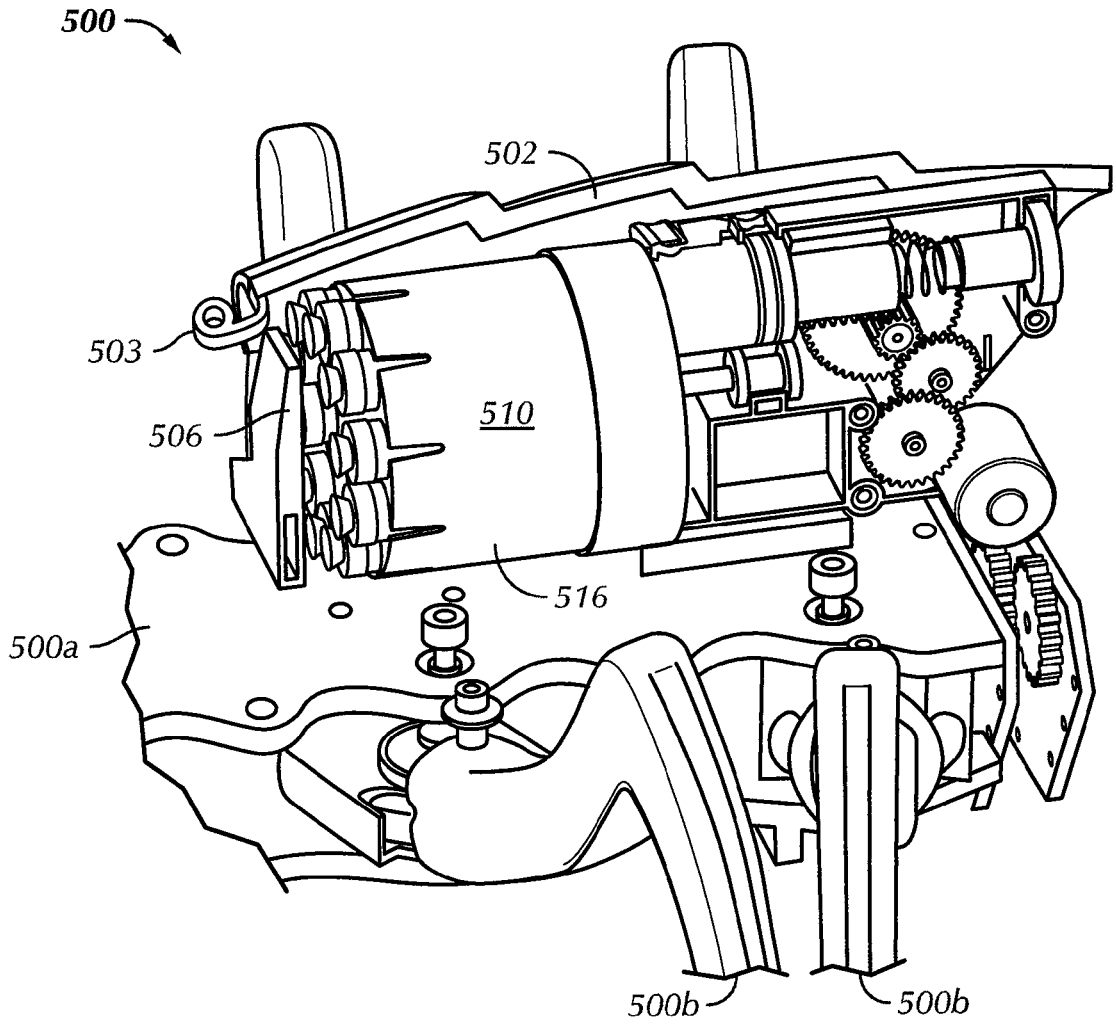
FIG. 17 is a perspective view of the left side of a fifth embodiment soft dart launcher mounted under cover on a another toy vehicle.
Figure 18:
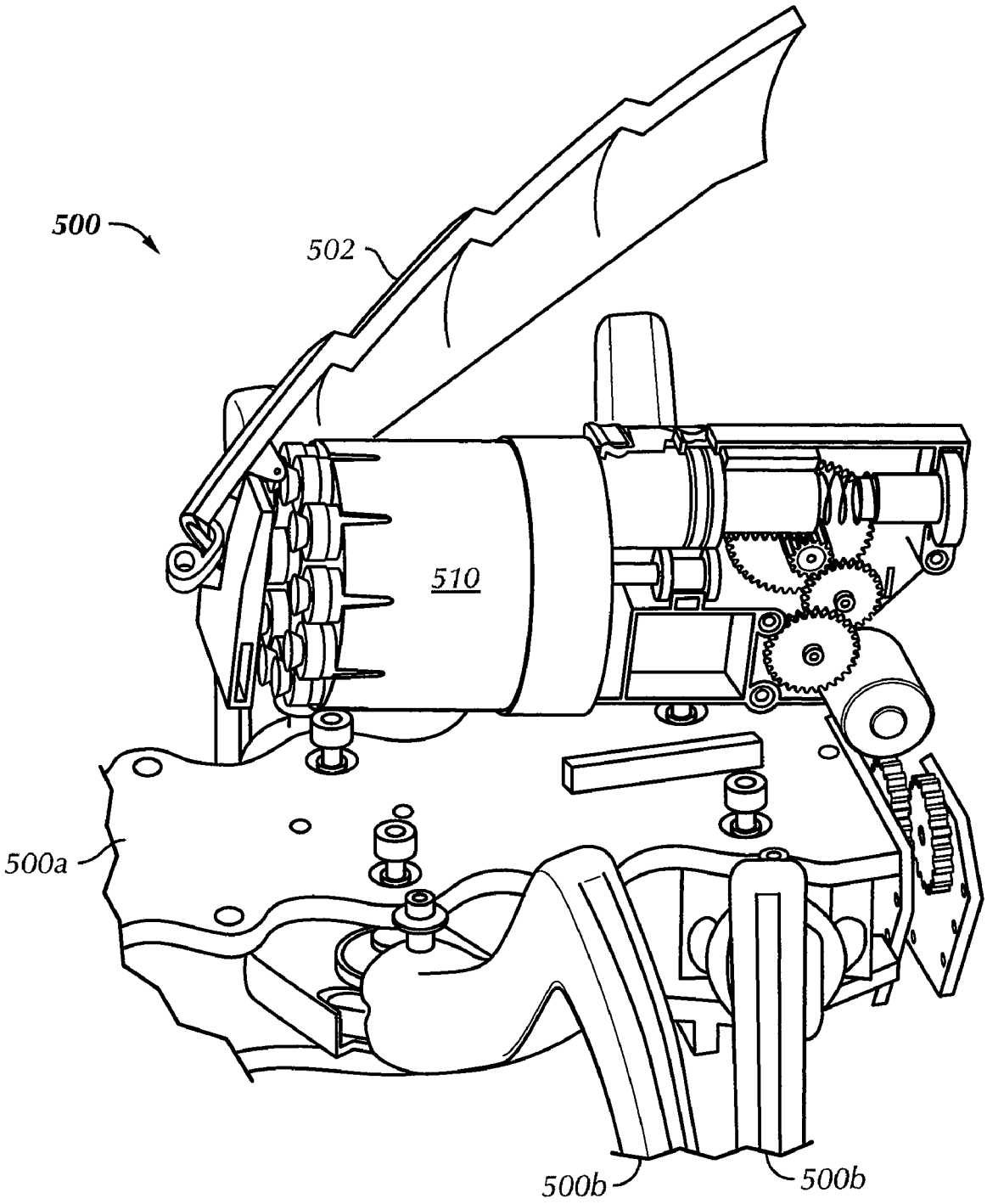
FIG. 18 is the same perspective view of the soft dart launcher of FIG. 17 elevated of the toy vehicle.

It may be desired to conceal the launcher for play value. One or more covers may be movably attached to a toy vehicle 500 for selectively covering a launcher 510. Referring to FIGS. 17-18, preferably, two covers 502, although it is within the spirit and scope of the present invention that there be more or less than two covers, provided the covers function to selectively cover the launcher 510, as described below. It is noted that only one cover 502 is shown in the figures, with another cover being omitted to better see the launcher 510. The other cover is suggestedly substantially similar to the depicted cover 502, and is preferably generally a mirror image of the depicted cover 502. While the cover(s) 502 may have different forms, the illustrated cover 502 is in the form of an insect wing to go with a toy vehicle 500 having a chassis 500*a* with multiple walking legs 500*b* for movement.

Each cover(s) 502 is preferably attached to the toy vehicle 500 with compound angled hinge to allow the cover(s) 502 to open upwardly and outwardly away from the launcher 510 when the launcher is elevated. This movement allows the launcher 510 to at least partially clear the cover 502 when in at least the angled upward launch position to enable soft darts to be launched from the launcher 210. Preferably, the covers 502 are opened with one or more abutment surfaces 506 on the launcher 510 that bear against parts 503 of the covers 502 to cause the covers 502 to rotate on their hinges to an open position as the launcher 510 elevates to the launch upwardly angled, launch position in FIG. 18 and to return to a closed position as the launcher 510 lowers to the horizontal storage position in FIG. 17. Although this configuration is preferred, it is within the present invention that the covers 502 be opened and closed in a different manner. For instance, one or more camming surfaces can be provided on the inner side of each cover 502 to ride along the circumferential surface of the magazine 516. The covers could be movably coupled with the launcher 210 in other ways, including, but not limited to using a gear train between the covers 502 and the motor 50 to enable the motor 50 to drive the not depicted covers 502 open and/or closed. The toy vehicle 500 may alternatively include a separate motor dedicated to driving the cover(s) open and closed. A cover may be mounted to the launcher 510 itself to rise and fall with the launcher 510. The launcher need only be raised sufficiently to expose the uppermost bore position to launch the dart occupying that position.

Figure 19:
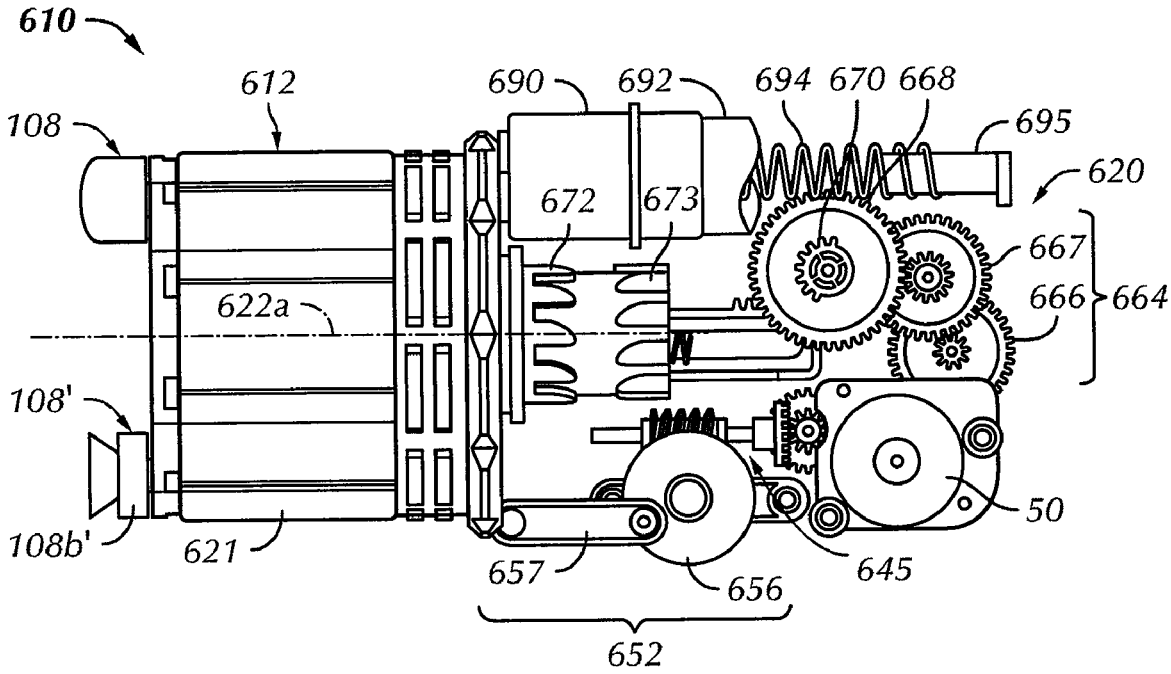
FIG. 19 is an elevation view of the components of a sixth embodiment soft dart launcher of the present invention from the left side of the launcher.
Figure 20:
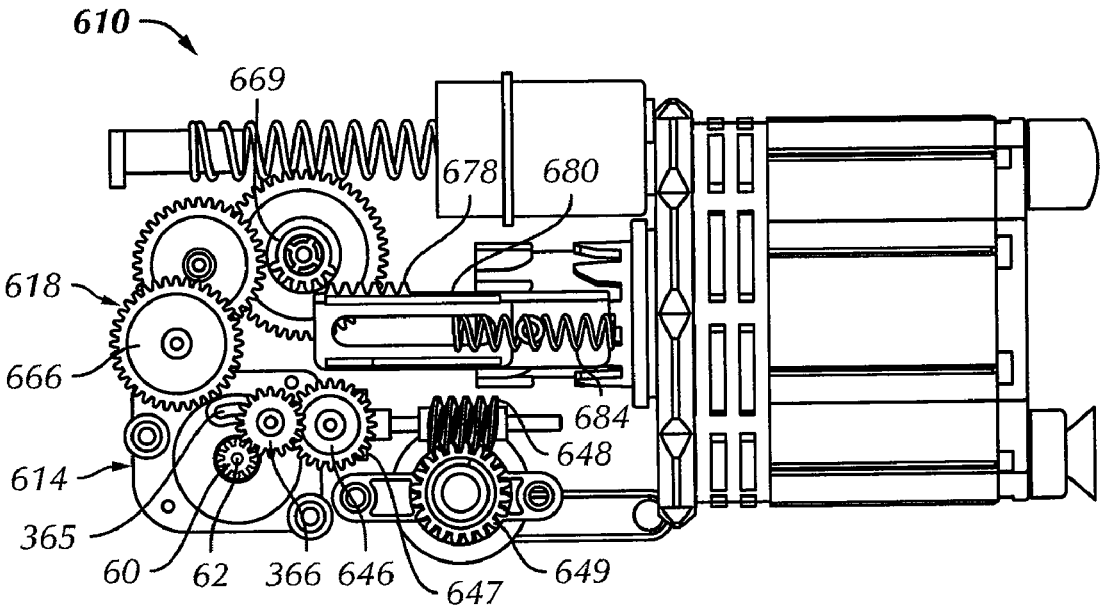
FIG. 20 is an elevation view of the components of a sixth embodiment soft dart launcher of the present invention from the right side of the launcher.

FIGS. 19 and 20 depict a sixth embodiment toy dart launcher of the present invention designated generally as 610. The launcher 610 includes elevation, dart magazine, dart magazine rotator and dart launcher subassemblies indicated generally at 614, 616, 618 and 620, respectively. Drive train 664 is a gear train that includes spur reduction gears 666, 667 and 668 where the first spur gear 666 is rotated by the toggle gear 366 when the motor 50 drives pinion 60 in a counterclockwise direction looking at the pinion in FIG. 20. Sector gears 669 and 670 reciprocate the piston 692 and reciprocate the elongated member 680 and turner 682 in synchronization. When the motor drives pinion 60 in a clockwise direction, toggle gear 366 disengages from gear 666 and slides across slot 365 into engagement with gear 646 of elevation subassembly drive train 645. Other component of train 645 include crown gear 647, worm 648 and worm gear 649. Worm gear 649 supports an eccentric in the form of a crank 656, which is pivotally coupled to one end of a link 657. The crank 656 and link 657 collectively constitute a lift device driven by train 645.

The major difference between launcher 610 and prior embodiments is that the dart magazine rotator subassemby 618 is located within between the central axis 622*a* of the magazine 621 and the outer periphery of the magazine 621. This is accomplished by an extension of a cylinder 631 rearward from the magazine 621 and providing a plurality of alternating lugs 672 and 673 in two transverse but separated parallel planes perpendicular to the central axis 622a. Ion this configuration, the turner 682 is fixed at the distal end of the elongated push member 680 and provided with opposing beveled surfaces one of which strikes one of the lugs 672 when the elongated member is driven towards the magazine 621 and the other of which strike one of the lugs 673 when the elongated member is bias back to its position away from the magazine 621. Thus, the magazine is rotated the predetermined angular amount need to move the next dart 108 in front of the air pump in two partial rotations.

U.S. Patent Application Nos. 60/722,930, 60/733,551 and 60/846,124 filed on 30 Sep. 2005, Nov. 4, 2006 and Sep. 4, 2006, respectively, are incorporated by reference herein in their entireties.

While wireless remotely controlled toy vehicles have been disclosed, other type of vehicles including wire remote controlled, and self operating toy vehicles might be used to transport and operate toy dart launchers of the present invention. Self-operating vehicles might be preprogram to operate in a predetermined way or randomly string together preprogrammed operating segments or equipped with suitable sensors to respond automatically either by changing movement of the vehicle or operation of the toy dart launcher or both when encountering an obstacle.

From the foregoing it can be seen that the present invention comprises a toy dart launcher 10, 110, 210, 310, 410, 510, 610 capable of launching a single soft dart or a plurality of soft darts on a generally continuous sequential basis without the need to store pressurized air. It will be appreciated by those skilled in the art that changes could be made to the embodiments described above without departing from the broad inventive concepts thereof. While configured for automatic firing, the launcher can be configured mechanically or electro-mechanically to fire one dart at a time, for example by including a switch or sensor which indicates when the last or nearly last motion or action associated with a dart firing is completed or by automatically timing of the motor actuation with the vehicle controller 105. It is understood, therefore, that this invention is not limited to the particular embodiments disclosed, but it is intended to cover modifications within the spirit and scope of the present invention.

The invention claimed is:

1. A toy dart launcher comprising:

a housing;

a magazine subassembly having a central axis and supported by the housing for rotation about the central axis, the magazine subassembly including a magazine having a plurality of bores generally circularly arranged around the central axis, each bore configured to receive a soft toy dart, the magazine further including an opening at an inner end of each bore;

a motor supported by the housing;

a magazine rotator subassembly supported by the housing so as to be operably coupled with the magazine subassembly and configured to cyclically operate to rotate the magazine about the central axis in a cyclic manner a uniform angular amount each cycle;

a dart launcher subassembly supported by the housing operably coupled with the magazine, the dart launcher subassembly including an air cylinder and a piston within the air cylinder, the air cylinder having a passageway therefrom in alignment with the opening at the inner end of each bore, when the bore is in position juxtaposed to the passageway, such that air pressurized in the air cylinder by the piston passes through the passageway and through the opening and into the juxtaposed bore, the dart launcher subassembly lacking valving to maintain air pressurized in the dart launcher subassembly for delayed release;

a drive train operably coupling the motor with the piston to cyclically reciprocate the piston in the air cylinder and with the magazine rotator subassembly to cyclically rotate the magazine the uniform angular amount in coordination with the reciprocation of the piston such that the magazine is rotated the uniform angular amount with one reciprocation of the piston in the cylinder, such that during each complete rotation of the magazine about the central axis, the opening at the inner end of each bore is positioned once juxtaposed to the air cylinder passageway and in fluid communication with the air cylinder at least as the piston is moved by the drive train to pressurize air in the air cylinder;

an elevation mechanism supported by the housing and operably coupled with the motor to raise and lower the launcher with respect to a surface supporting the launcher, the elevation mechanism including an elevation device and drive train operably coupling the elevation device with the motor; and means operably coupling the motor with the magazine rotator subassembly and the dart launcher subassembly to rotate the magazine and reciprocate the piston only with rotation of the motor in a first direction and to operate the elevation mechanism only with rotation of the motor in a second direction opposite the first direction.

2. The toy dart launcher of claim 1 further comprising a toy vehicle supporting the toy dart launcher for movement.

3. The toy dart launcher of claim 2 further comprising a power supply on the toy vehicle to supply power to the vehicle for vehicle movement and electrically coupled with the motor to supply power to operate the soft dart launcher.

4. A method of operating a toy launcher to launch soft darts, the launcher including a housing; a dart magazine subassembly rotatably supported by the housing; a dart magazine rotation subassembly supported by the housing and a dart launcher assembly supported by the housing, the method comprising the steps of: providing a motor in the housing; operating the dart magazine rotation subassembly with the motor rotating in a first direction; simultaneously operating the dart launcher assembly with the motor; providing an elevation mechanism operatively connected with the housing and the motor; and operating the motor in a second, reverse direction to raise and lower the housing with the elevation mechanism.

* * * * *